US010510299B2

(12) United States Patent
Xu et al.

(10) Patent No.: US 10,510,299 B2
(45) Date of Patent: Dec. 17, 2019

(54) PIXEL ILLUMINATION COMPENSATION METHOD, PIXEL ILLUMINATION COMPENSATION APPARATUS AND DISPLAY DEVICE INCORPORATING THE APPARATUS

(71) Applicants: BOE TECHNOLOGY GROUP CO., LTD., Beijing (CN); Hefei Xinsheng Optoelectronics Technology Co., Ltd., Anhui (CN)

(72) Inventors: Haixia Xu, Beijing (CN); Yue Wu, Beijing (CN); Heng Li, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 0 days.

(21) Appl. No.: 15/992,933

(22) Filed: May 30, 2018

(65) Prior Publication Data

US 2019/0066591 A1 Feb. 28, 2019

(30) Foreign Application Priority Data

Aug. 29, 2017 (CN) ..... 2017 1 0757114

(51) Int. Cl.
*G09G 3/3258* (2016.01)
*G09G 3/20* (2006.01)

(52) U.S. Cl.
CPC ..... *G09G 3/3258* (2013.01); *G09G 3/2074* (2013.01); *G09G 2300/0443* (2013.01);
(Continued)

(58) Field of Classification Search
CPC ... G09G 2300/0443; G09G 2300/0452; G09G 2310/0259
See application file for complete search history.

(56) References Cited

U.S. PATENT DOCUMENTS 10,229,636 B2 * 3/2019 Kim ..... G09G 3/3233
2012/0139955 A1 * 6/2012 Jaffari ..... G06F 17/5018 345/690

(Continued)

*Primary Examiner* — Chun-Nan Lin
(74) *Attorney, Agent, or Firm* — Calfee, Halter & Griswold LLP

(57) ABSTRACT

A pixel compensation method, pixel compensation apparatus and display device are provided. In the blanking section of $(2n-1)^{th}$ display frame, the detection line corresponding to the first sub-pixel column of the same color sub-pixels in the $n^{th}$ row is charged with an additional detection voltage, such that the detected voltage on this detection line is the sum of the detection voltage and a coupling voltage. The detection line corresponding to the second sub-pixel column of the same color sub-pixels is not charged with the additional detection voltage, such that the detected voltage on this detection line is the coupling voltage. The detection voltage corresponding to the first sub-pixel column is obtained according to the voltage on the detection line corresponding to each of the same color sub-pixels. Similarly, in the blanking section of $(2n)^{th}$ display frame, the detection voltage corresponding to the second sub-pixel column may be obtained.

19 Claims, 5 Drawing Sheets

(52) U.S. Cl.
CPC ..... *G09G 2300/0452* (2013.01); *G09G 2320/0233* (2013.01)

(56) References Cited

U.S. PATENT DOCUMENTS

2017/0256198 A1* 9/2017 Hwang ..... G09G 3/3225
2019/0066590 A1* 2/2019 Li ..... G09G 3/3258

* cited by examiner

PIXEL ILLUMINATION COMPENSATION METHOD, PIXEL ILLUMINATION COMPENSATION APPARATUS AND DISPLAY DEVICE INCORPORATING THE APPARATUS

CROSS-REFERENCE

The present application is based upon and claims priority to Chinese Patent Application No. 201710757114.4, filed on Aug. 29, 2017, and the entire contents thereof are incorporated herein by reference.

TECHNICAL FIELD

The present disclosure relates to the field of display technologies, and in particular, to a pixel compensation method, a pixel compensation apparatus and a display device.

BACKGROUND

Electroluminescent diodes such as Organic Light Emitting Diodes (OLEDs), Quantum Dot Light Emitting Diodes (QLEDs) and the like have the advantages of self-luminescence, low power consumption, and the like, which have become the application and research hotspots in the electroluminescent display panel filed. Currently, the electroluminescent diodes are generally current-driven and require a stable current to drive their light emission. And a pixel circuit is used in the electroluminescent display panel to drive the electroluminescent diode to emit light.

SUMMARY

The embodiments of the present disclosure provide a pixel compensation method, a pixel compensation apparatus, and a display device.

Embodiments of the present disclosure provides a pixel compensation method for compensation of pixels in an electroluminescent display panel, wherein the electroluminescent display panel comprises a plurality of pixels and a plurality of detection lines, each column of the pixels corresponds to one of the detection lines, each of the pixels comprises a plurality of sub-pixels of different colors, respective sub-pixels in a same pixel are coupled to a same detection line, the sub-pixels of a same color in each row are divided into a first sub-pixel column and a second sub-pixel column that are alternately arranged, the first sub-pixel column is one of an odd column of the sub-pixels of the same color in the row and an even column of the sub-pixels of the same color in the row, and the method includes:

in a compensation stage of a compensation period, in a blanking section of a $(2n-1)^{th}$ display frame, charging the detection line corresponding to the first sub-pixel column of the sub-pixels of the same color to be compensated in a $n^{th}$ row, detecting a voltage on the detection line corresponding to each of the sub-pixels of the same color to be compensated in the $n^{th}$ row, and determining a detection voltage corresponding to the first sub-pixel column in the $n^{th}$ row according to a detected voltage, where n is an integer greater than or equal to 1 and less than or equal to N, and N is a number of rows of the sub-pixels of the same color to be compensated in the electroluminescent display panel;

in the blanking section of a $(2n)^{th}$ display frame, charging the detection line corresponding to the second sub-pixel column of the sub-pixels of the same color to be compensated in the $n^{th}$ row, detecting the voltage on the detection line corresponding to each of the sub-pixels of the same color to be compensated in the $n^{th}$ row, and determining a detection voltage corresponding to the second sub-pixel column in the $n^{th}$ row according to a detected voltage; and determining a data voltage of each of the sub-pixels of the same color to be compensated in the $n^{th}$ row for display frames after the $(2n)^{th}$ display frame according to the detection voltage corresponding to each of the sub-pixels of the same color to be compensated in the $n^{th}$ row.

Optionally, in the pixel compensation method provided by an embodiment of the present disclosure, the sub-pixel includes a pixel circuit and a light emitting device coupled to the pixel circuit, and the pixel circuit is coupled to a corresponding detection line;

the charging the detection line corresponding to the first sub-pixel column of the sub-pixels of the same color to be compensated in a $n^{th}$ row includes: applying a data voltage corresponding to a non-zero gray level to the first sub-pixel column of the sub-pixels of the same color to be compensated in the $n^{th}$ row, and controlling the pixel circuit in the first sub-pixel column to charge the detection line; and the charging the detection line corresponding to the second sub-pixel column of the sub-pixels of the same color to be compensated in the $n^{th}$ row includes: applying the data voltage corresponding to the non-zero gray level to the second sub-pixel column of the sub-pixels of the same color to be compensated in the $n^{th}$ row, and controlling the pixel circuit in the second sub-pixel column to charge the detection line.

Optionally, in the pixel compensation method provided by an embodiment of the present disclosure, the method further includes:

when applying a data voltage corresponding to a non-zero gray level to the first sub-pixel column of the sub-pixels of the same color to be compensated in the $n^{th}$ row, applying a data voltage corresponding to a zero gray level to the second sub-pixel column of the sub-pixels of the same color to be compensated in the $n^{th}$ row, and controlling the pixel circuit in the second sub-pixel column to charge the detection line; and when applying the data voltage corresponding to the non-zero gray level to the second sub-pixel column of the sub-pixels of the same color to be compensated in the $n^{th}$ row, applying the data voltage corresponding to the zero gray level to the first sub-pixel column of the sub-pixels of the same color to be compensated in the $n^{th}$ row, and controlling the pixel circuit in the first sub-pixel column to charge the detection line.

Optionally, in the pixel compensation method provided by an embodiment of the present disclosure, the determining a detection voltage corresponding to the first sub-pixel column in the $n^{th}$ row according to a detected voltage includes: according to the detected voltages on the detection lines corresponding to the sub-pixels of the same color to be compensated, calculating a voltage difference between voltages on the detection lines corresponding to two adjacent sub-pixels of the same color to be compensated in the $n^{th}$ row, to determine the detection voltage corresponding to the first sub-pixel column in the $n^{th}$ row; and the determining a detection voltage corresponding to the second sub-pixel column in the $n^{th}$ row according to a detected voltage includes: according to the detected voltages on the detection lines corresponding to the sub-pixels of the same color to be compensated, calculating the voltage difference between the voltages on the detection lines corresponding to the two adjacent sub-pixels of the same color to be compensated in the $n^{th}$ row, to determine the detection voltage corresponding to the second sub-pixel column in the $n^{th}$ row.

Optionally, in the pixel compensation method provided by an embodiment of the present disclosure, the method further includes after the determining a detection voltage corresponding to the first sub-pixel column in the $n^{th}$ row, and before the determining a data voltage of each of the sub-pixels of the same color to be compensated in the $n^{th}$ row for the display frames after the $(2n)^{th}$ display frame: storing the detection voltage corresponding to the first sub-pixel column in the $n^{th}$ row; and the method further includes after the determining a detection voltage corresponding to the second sub-pixel column in the $n^{th}$ row, and before the determining a data voltage of each of the sub-pixels of the same color to be compensated in the $n^{th}$ row for the display frames after the $(2n)^{th}$ display frame: storing the detection voltage corresponding to the second sub-pixel column in the $n^{th}$ row.

Optionally, in the pixel compensation method provided by an embodiment of the present disclosure, the electroluminescent display panel includes a red sub-pixel, a green sub-pixel and a blue sub-pixel, the compensation period includes three compensation stages arranged in sequence, and each of the compensation stages corresponds to one of the red sub-pixel, the green sub-pixel and the blue sub-pixel; or the electroluminescent display panel includes a red sub-pixel, a green sub-pixel, a blue sub-pixel and a white sub-pixel, the compensation period includes four compensation stages arranged in sequence, and each of the compensation stages corresponds to one of the red sub-pixel, the green sub-pixel, the blue sub-pixel and the white sub-pixel.

Optionally, in the pixel compensation method provided by an embodiment of the present disclosure, when the compensation period includes three compensation stages arranged in sequence, the sub-pixels to be compensated in the three compensation stages are in the order of the red sub-pixel, the green sub-pixel and the blue sub-pixel; and when the compensation period includes four compensation stages arranged in sequence, the sub-pixels to be compensated in the four compensation stages are in the order of the red sub-pixel, the green sub-pixel, the blue sub-pixel and the white sub-pixel.

Correspondingly, the embodiments of the present disclosure also provides a pixel compensation apparatus for compensation of pixels in an electroluminescent display panel, wherein the electroluminescent display panel comprises a plurality of pixels and a plurality of detection lines, each column of the pixels corresponds to one of the detection lines, each of the pixels comprises a plurality of sub-pixels of different colors, respective sub-pixels in a same pixel are coupled to a same detection line, the sub-pixels of a same color in each row are divided into a first sub-pixel column and a second sub-pixel column that are alternately arranged, the first sub-pixel column is one of an odd column of the sub-pixels of the same color in the row and an even column of the sub-pixels of the same color in the row, and the pixel compensation apparatus includes:

a first detection determining circuit, configured to, in a compensation stage of a compensation period, in a blanking section of a $(2n-1)^{th}$ display frame, charge the detection line corresponding to the first sub-pixel column of the sub-pixels of the same color to be compensated in a $n^{th}$ row, detect a voltage on the detection line corresponding to each of the sub-pixels of the same color to be compensated in the $n^{th}$ row, and determine a detection voltage corresponding to the first sub-pixel column in the $n^{th}$ row according to a detected voltage, where n is an integer greater than or equal to 1 and less than or equal to N, and N is a number of rows of the sub-pixels of the same color to be compensated in the electroluminescent display panel;

a second detection determining circuit, configured to, in the blanking section of a $(2n)^{th}$ display frame, charge the detection line corresponding to the second sub-pixel column of the sub-pixels of the same color to be compensated in the $n^{th}$ row, detect the voltage on the detection line corresponding to each of the sub-pixels of the same color to be compensated in the $n^{th}$ row, and determine a detection voltage corresponding to the second sub-pixel column in the $n^{th}$ row according to a detected voltage; and a data determining circuit, configured to determine a data voltage of each of the sub-pixels of the same color to be compensated in the $n^{th}$ row for display frames after the $(2n)^{th}$ display frame according to the detection voltage corresponding to each of the sub-pixels of the same color to be compensated in the $n^{th}$ row.

Optionally, in the pixel compensation apparatus provided by an embodiment of the present disclosure, the sub-pixel comprises a pixel circuit and a light emitting device coupled to the pixel circuit, and the pixel circuit is coupled to a corresponding detection line;

the first detection determining circuit is configured to apply a data voltage corresponding to a non-zero gray level to the first sub-pixel column of the sub-pixels of the same color to be compensated in the $n^{th}$ row, and control the pixel circuit in the first sub-pixel column to charge the detection line; and the second detection determining circuit is configured to apply the data voltage corresponding to the non-zero gray level to the second sub-pixel column of the sub-pixels of the same color to be compensated in the $n^{th}$ row, and control the pixel circuit in the second sub-pixel column to charge the detection line.

Optionally, in the pixel compensation apparatus provided by an embodiment of the present disclosure, the first detection determining circuit is further configured to apply a data voltage corresponding to a zero gray level to the second sub-pixel column of the sub-pixels of the same color to be compensated in the $n^{th}$ row, and control the pixel circuit in the second sub-pixel column to charge the detection line; and the second detection determining circuit is further configured to apply the data voltage corresponding to the zero gray level to the first sub-pixel column of the sub-pixels of the same color to be compensated in the $n^{th}$ row, and control the pixel circuit in the first sub-pixel column to charge the detection line.

Optionally, in the pixel compensation apparatus provided by an embodiment of the present disclosure, the first detection determining circuit is configured to: according to the detected voltages on the detection lines corresponding to the sub-pixels of the same color to be compensated, calculate a voltage difference between voltages on the detection lines corresponding to two adjacent sub-pixels of the same color to be compensated in the $n^{th}$ row, to determine the detection voltage corresponding to the first sub-pixel column in the $n^{th}$ row; and the second detection determining circuit is configured to: according to the detected voltages on the detection lines corresponding to the sub-pixels of the same color to be compensated, calculate the voltage difference between the voltages on the detection lines corresponding to the two adjacent sub-pixels of the same color to be compensated in the $n^{th}$ row, to determine the detection voltage corresponding to the second sub-pixel column in the $n^{th}$ row.

Optionally, in the pixel compensation apparatus provided by an embodiment of the present disclosure, the pixel compensation apparatus further includes:

a first storage circuit configured to store the detection voltage corresponding to the first sub-pixel column in the $n^{th}$ row; and a second storage circuit configured to store the detection voltage corresponding to the second sub-pixel column in the $n^{th}$ row Optionally, in the pixel compensation apparatus provided by an embodiment of the present disclosure, the electroluminescent display panel includes a red sub-pixel, a green sub-pixel and a blue sub-pixel, the compensation period includes three compensation stages arranged in sequence, and each of the compensation stages corresponds to one of the red sub-pixel, the green sub-pixel and the blue sub-pixel; or the electroluminescent display panel includes a red sub-pixel, a green sub-pixel, a blue sub-pixel and a white sub-pixel, the compensation period includes four compensation stages arranged in sequence, and each of the compensation stages corresponds to one of the red sub-pixel, the green sub-pixel, the blue sub-pixel and the white sub-pixel.

Optionally, in the pixel compensation apparatus provided by an embodiment of the present disclosure, when the compensation period includes the three compensation stages arranged in sequence, the sub-pixels to be compensated in the three compensation stages are in the order of the red sub-pixel, the green sub-pixel and the blue sub-pixel; and when the compensation period includes the four compensation stages arranged in sequence, the sub-pixels to be color compensated in the four compensation stages are in the order of the red sub-pixel, the green sub-pixel, the blue sub-pixel and the white sub-pixel.

Correspondingly, the embodiments of the present disclosure also provide a display device including the pixel compensation apparatus according to the above embodiment.

DETAILED DESCRIPTION

In order to make the objectives, technical solutions and advantages of the present disclosure clearer, a specific implementation of a pixel compensation method, a pixel compensation apparatus, and a display device provided by the embodiments of the present disclosure will be described in detail below with reference to the accompanying drawings. It should be understood that the embodiments described below are only used to illustrate and explain the present disclosure and are not intended to limit the present disclosure. The embodiments in the present application and the features in the embodiments can be combined with each other without conflict.

Figure 1:
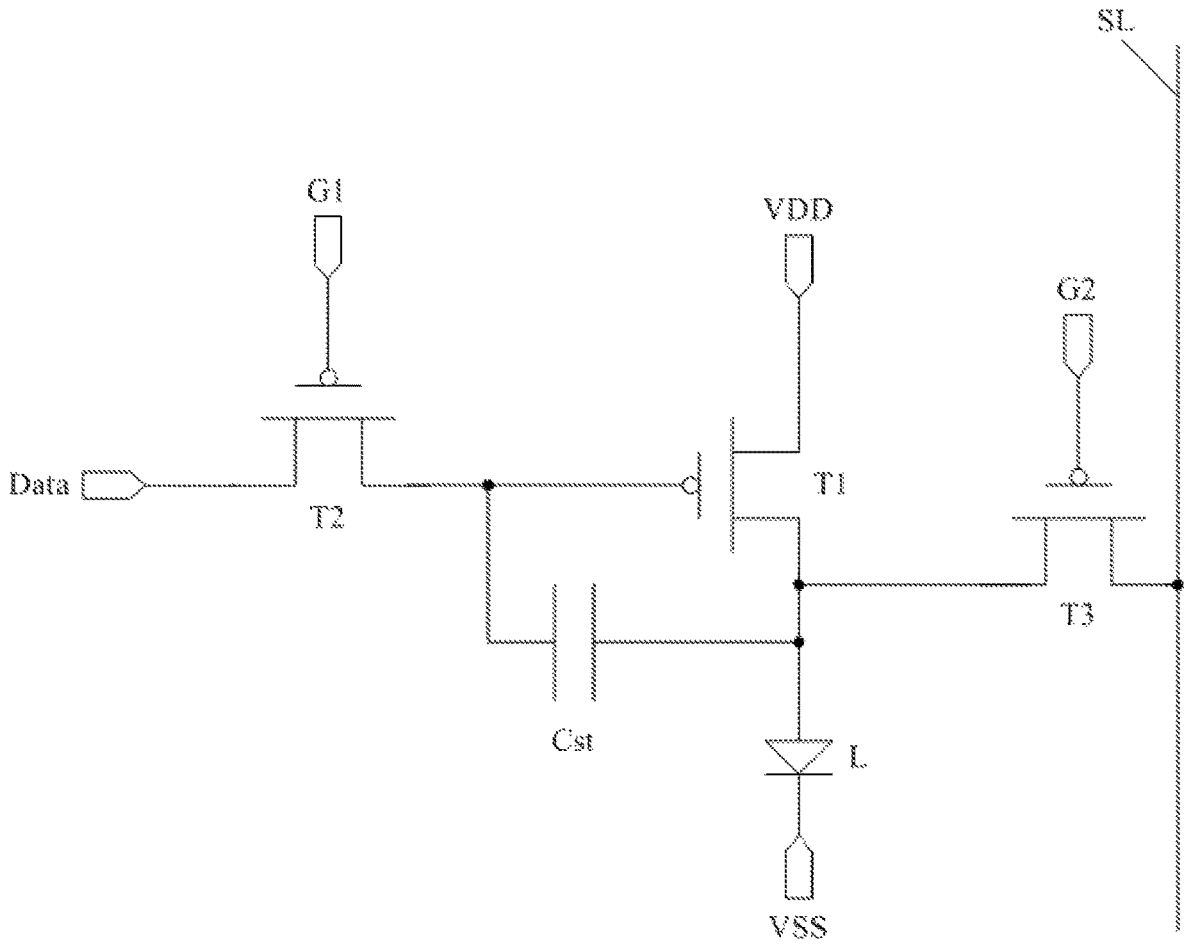
FIG. 1 is a schematic structural diagram of a pixel circuit.

A pixel circuit is as shown in FIG. 1 and generally includes a driving transistor T1, a switching transistor T2, and a storage capacitor Cst. The pixel circuit controls the switching transistor T2 to be turned on to write the data voltage of the data signal terminal Data to the gate electrode of the driving transistor T1, so as to control the driving transistor T1 to generate an operating current to drive the electroluminescent diode L to emit light. However, as the operation time accumulates, the driving transistor T1 may suffer from aging and the like, which causes the threshold voltage and the mobility of the driving transistor T1 to shift, thereby causing a difference in display brightness.

In order to ensure the display quality, the threshold voltage and the mobility of the driving transistor can be compensated by external compensation. As shown in FIG. 1, it is also necessary to provide a detection line SL in the electroluminescent display panel and a detection transistor T3 coupled to the drain electrode of the driving transistor T1 in the pixel circuit. When compensating one row of pixels in the electroluminescent display panel, the pixel circuit of each sub-pixel in the row is controlled to charge the detection line SL. Then the voltage on each detection line is detected, and compensation calculation is performed according to the detected voltage to obtain the data voltage corresponding to each sub-pixel in the row for display. However, since the electroluminescent display panel also has a variety of signal lines, a coupling capacitance exists between the detection line and other signal lines. Due to the coupling capacitance, the signal of the detection line changes when the electroluminescent display panel switches the screen, resulting in inaccuracy of the detected voltage on the detection line, which leads to the problem that inaccurate data voltage obtained by the compensation calculation influences the screen display effect.

Figure 2A:
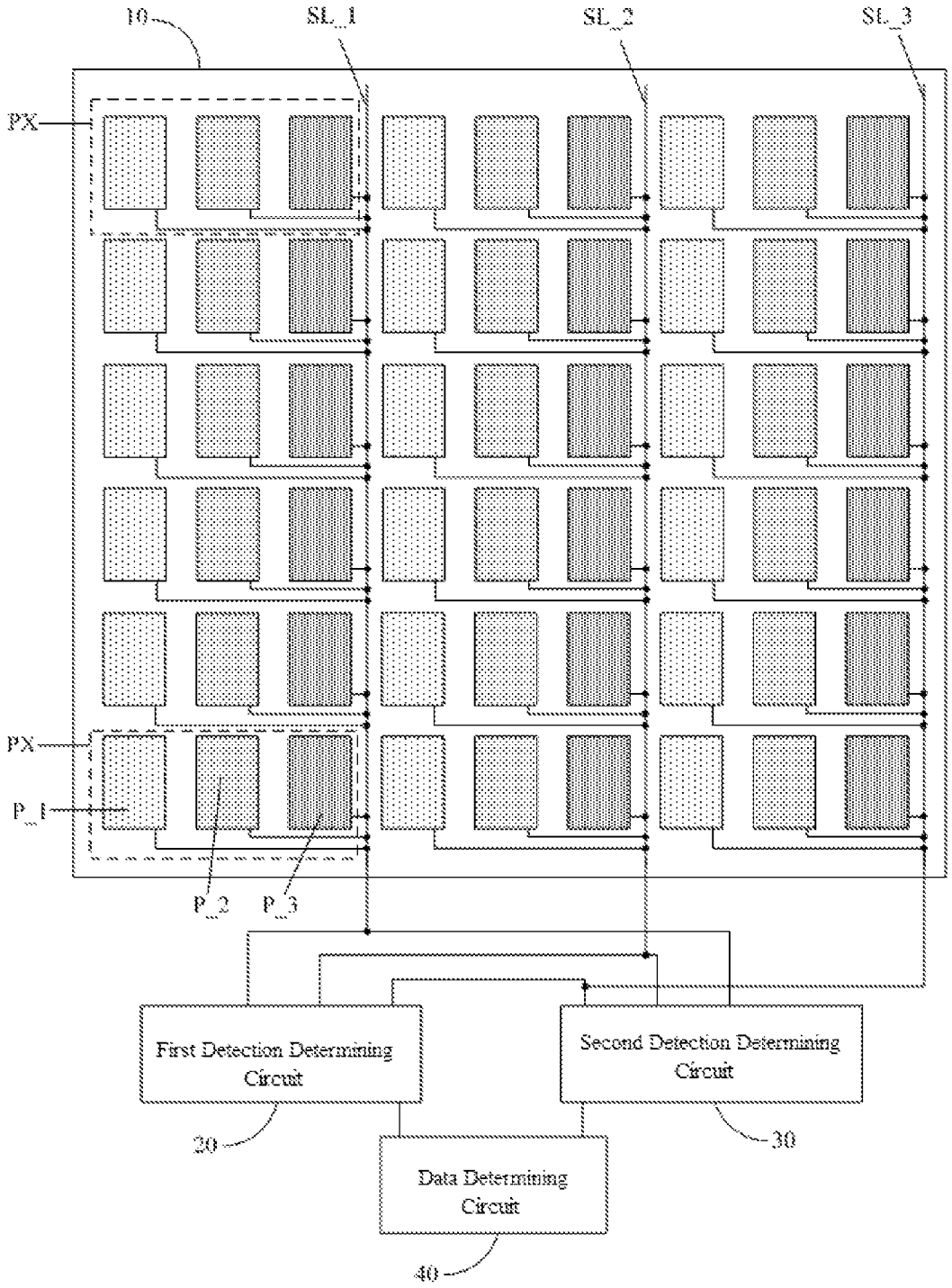
FIG. 2*a* is a first schematic structural diagram of a pixel compensation apparatus according to an embodiment of the present disclosure.
Figure 2B:
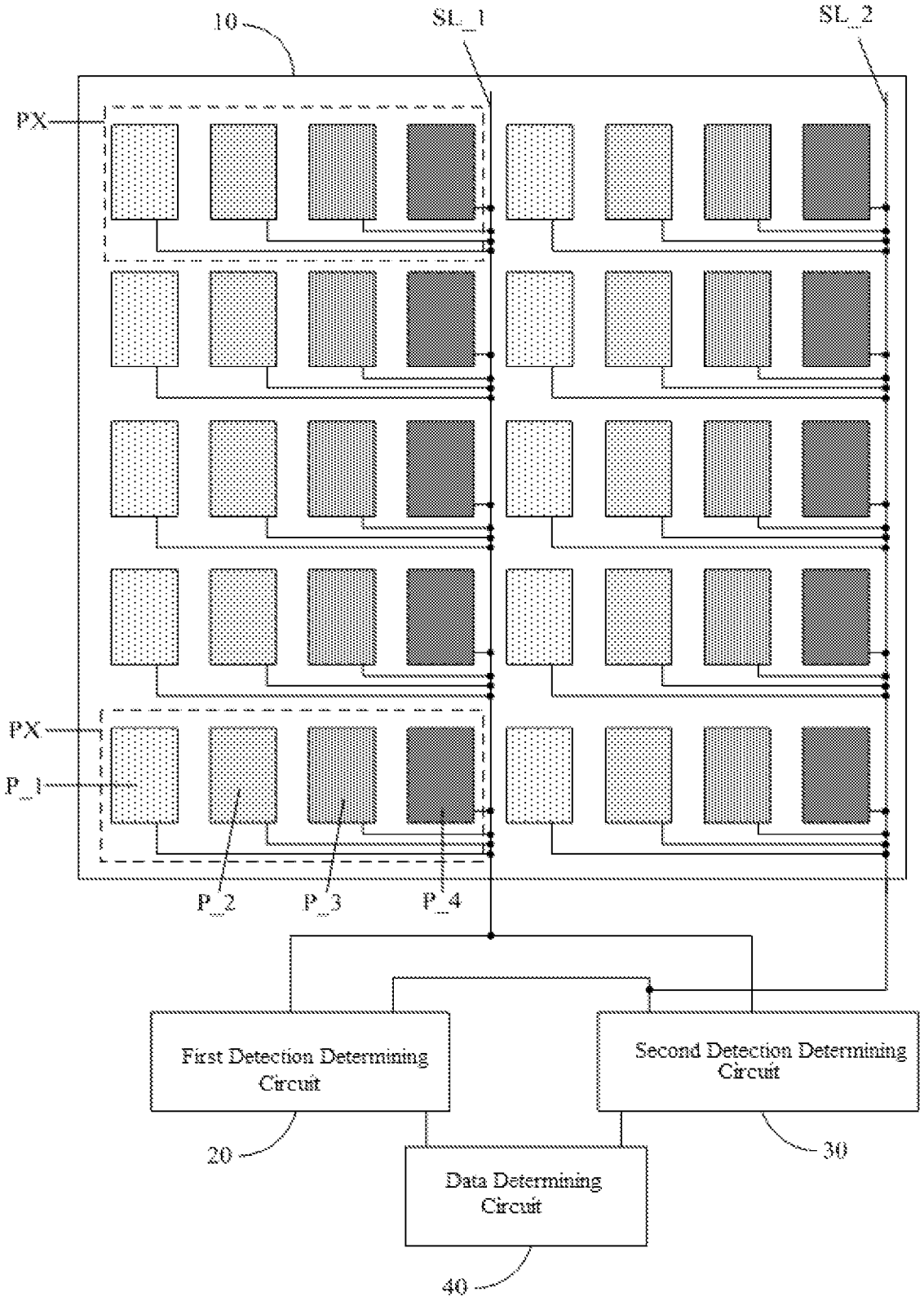
FIG. 2*b* is a second schematic structural diagram of a pixel compensation apparatus according to an embodiment of the present disclosure.

An embodiment of the present disclosure provides a pixel compensation method for compensation for pixels in an electroluminescent display panel. As shown in FIG. 2*a* and FIG. 2*b* (FIG. 2*a* shows an example in which the sub-pixels in the electroluminescent display panel 10 have three colors, FIG. 2*b* shows an example in which the sub-pixels in the electroluminescent display panel 10 have four colors), the electroluminescent display panel 10 includes a plurality of pixels PX and a plurality of detection lines SL_k (k=1, 2, 3, . . . , K, and K is the number of the columns of pixels in the electroluminescent display panel 10). Each column of pixels corresponds to one detection line. Each pixel PX includes a plurality of sub-pixels P_m (m=1, 2, 3, . . . , M, and M is the number of color types of the sub-pixels in the electroluminescent display panel 10) of different colors. Each sub-pixel P_m belonging to the same pixel PX is coupled to the same detection line, and sub-pixels of the same color in each row are divided into a first sub-pixel column and a second sub-pixel column that are arranged alternatively. The first sub-pixel column is an odd column of the same color sub-pixels in the corresponding row or an even column of the same color sub-pixels in the corresponding row.

Figure 3:
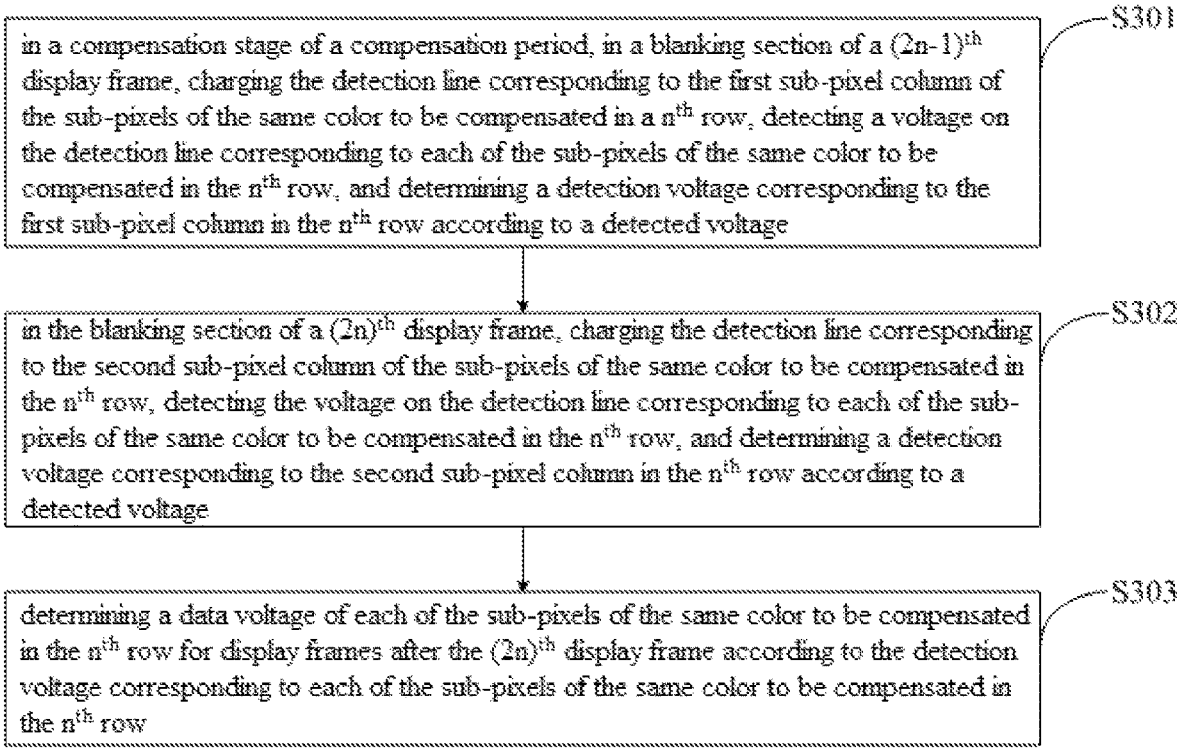
FIG. 3 is a flowchart of a pixel compensation method according to an embodiment of the present disclosure.

As shown in FIG. 3, the pixel compensation method provided in the embodiment of the present disclosure may include:

step S301, in a compensation stage of a compensation period, in a blanking section of a $(2n-1)^{th}$ display frame, charging the detection line corresponding to the first sub-pixel column of the sub-pixels of the same color to be compensated in a $n^{th}$ row, detecting a voltage on the detection line corresponding to each of the sub-pixels of the same color to be compensated in the $n^{th}$ row, and determining a detection voltage corresponding to the first sub-pixel column in the $n^{th}$ row according to a detected voltage, where n is an integer greater than or equal to 1 and less than or equal to N, and N is a number of rows of the sub-pixels of the same color to be compensated in the electroluminescent display panel;

step S302, in the blanking section of a $(2n)^{th}$ display frame, charging the detection line corresponding to the second sub-pixel column of the sub-pixels of the same color to be compensated in the $n^{th}$ row, detecting the voltage on the detection line corresponding to each of the sub-pixels of the same color to be compensated in the $n^{th}$ row, and determining a detection voltage corresponding to the second sub-pixel column in the $n^{th}$ row according to a detected voltage; and step S303, determining a data voltage of each of the sub-pixels of the same color to be compensated in the $n^{th}$ row for display frames after the $(2n)^{th}$ display frame according to the detection voltage corresponding to each of the sub-pixels of the same color to be compensated in the $n^{th}$ row.

The pixel compensation method provided by the embodiment of the present disclosure is applied to compensate the pixels in the electroluminescent display panel. In the blanking section of the $(2n-1)^{th}$ display frame of the compensation stage of the compensation period, the detection line corresponding to the first sub-pixel column of sub-pixels of the same color to be compensated in the $n^{th}$ row is charged with an additional detection voltage $V_0$, such that the detected voltage on the detection line corresponding to the first sub-pixel column is the sum of the detection voltage $V_0$ and a coupling voltage $\Delta V$ caused by coupling that is, $V_0+\Delta V$. In the blanking section of the $(2n-1)^{th}$ display frame, the detection line corresponding to the second sub-pixel column of the sub-pixels of the same color to be compensated is not charged with the additional detection voltage $V_0$, such that the detected voltage on the detection line corresponding to the second sub-pixel column is only the coupling voltage $\Delta V$. Then, it is possible to obtain the detection voltage $V_0$ corresponding to each sub-pixel in the first sub-pixel column according to the voltages on the detection lines corresponding to the sub-pixels of the same color to be compensated. Similarly, in the blanking section of the $(2n)^{th}$ display frame, the detection line corresponding to the second sub-pixel column of the sub-pixels of the same color to be compensated in the $n^{th}$ row is charged with the additional detection voltage $V_0$, such that the detected voltage on the detection line corresponding to the second sub-pixel column is $V_0+\Delta V$. In the blanking section of the $(2n)^{th}$ display frame, the detection line corresponding to the first sub-pixel column of the sub-pixels of the same color to be compensated is not charged with the additional detection voltage $V_0$, such that the detected voltage on the detection line corresponding to the first sub-pixel column is only the coupling voltage $\Delta V$. Then, it is possible to obtain the detection voltage $V_0$ corresponding to each sub-pixel in the second sub-pixel column according to the voltages on the detection lines corresponding to the sub-pixels of the same color to be compensated. In this way, the detection voltage $V_0$ corresponding to each sub-pixel of the same color to be compensated in the $n^{th}$ row can be obtained, therefore the influence of the coupling action on the detection voltage $V_0$ may be eliminated, and the accuracy of the detected voltage corresponding to each sub-pixel of the same color to be compensated is improved. Therefore, the problem that the data voltage obtained by the compensation calculation is inaccurate due to the voltage change on the detection line caused by the coupling action can be avoided, and the display effect of the screen can be improved.

It should be noted that during the scanning process of the display panel, the scanning always starts from the upper left corner of the image and travels horizontally forward while the scanning point also moves downward at a slower rate. When scanning a complete frame of the image, after the scanning of the frame is completed at the scanning points, it is necessary to return from the lower right corner of the image to the upper left corner of the image to start a new frame scan. This time interval is called field blanking. During the field blanking, the transmission of the data voltage for displaying the image is not performed. In order to achieve signal detection, since image display is not performed during the field blanking, the time of field blanking can be used for signal detection and determination. In a specific implementation, in the pixel compensation method provided in the embodiment of the present disclosure, the blanking section of the $(2n-1)^{th}$ display frame is the time duration of the field blanking in the $(2n-1)^{th}$ display frame, and the blanking section of the $(2n)^{th}$ display frame is the time duration of the field blanking in the $(2n)^{th}$ display frame.

In a specific implementation, in the pixel compensation method provided in the embodiment of the present disclosure, the sub-pixel of the electroluminescent display panel may specifically include a pixel circuit and a light emitting device coupled to the pixel circuit, and the pixel circuit is coupled to the detection line corresponding to the sub-pixel in which the pixel circuit is disposed. The light emitting device may be an organic light emitting diode; alternatively, the light emitting device may also be a quantum dot light emitting diode. However, the light emitting device may also be another type of electroluminescent diode capable of emitting light by itself, which is not limited herein.

To charge the detection line corresponding to the first sub-pixel column of the sub-pixels of the same color to be compensated in the $n^{th}$ row, the compensation method may specifically include: applying a data voltage corresponding to a non-zero gray level to the first sub-pixel column of the sub-pixels of the same color to be compensated in the $n^{th}$ row, and controlling the pixel circuit in the first sub-pixel column to charge the coupled detection line. In this way, the detection line corresponding to the first sub-pixel column of the sub-pixels of the same color to be compensated in the $n^{th}$ row is charged with the detection voltage.

In addition, to charge the detection line corresponding to the second sub-pixel column of the sub-pixels of the same color to be compensated in the $n^{th}$ row, the compensation method may specifically include: applying the data voltage corresponding to the non-zero gray level to the second sub-pixel column of the sub-pixels of the same color to be compensated in the $n^{th}$ row, and controlling the pixel circuit in the second sub-pixel column to charge the coupled detection line. In this way, the detection line corresponding to the second sub-pixel column of the sub-pixels of the same color to be compensated in the $n^{th}$ row is charged with the detection voltage.

In specific implementation, in the pixel compensation method provided in the embodiment of the present disclosure, as shown in FIG. 1, the pixel circuit may specifically include: a driving transistor T1, a switching transistor T2, a detection transistor T3 and a storage capacitor Cst. The switching transistor T2 has a gate electrode coupled to the first scan signal terminal G1, a source electrode coupled to the data signal terminal Data, and a drain electrode coupled to a gate electrode of the driving transistor T1 and a first terminal of the storage capacitor Cst. The driving transistor T1 has a source electrode coupled to the high voltage power supply terminal VDD, and a drain electrode respectively coupled to a second terminal of the storage capacitor Cst, a source electrode of the detection transistor T3 and an anode of the light emitting device L. A cathode of the light emitting device L is coupled to the low voltage power supply terminal VSS. A gate electrode of the detection transistor T3 is coupled to the second scan signal terminal G2, and a drain electrode of the detection transistor T3 is coupled to the corresponding detection line.

The display panel generally uses 64 gray levels, 256 gray levels, or 1024 gray levels to achieve image display. 64 gray levels represent 64 gray level values, where 0 represents the lowest gray level, that is, the gray level at which the display panel displays the darkest image, and 63 represents the highest gray level, that is, the gray level at which the display panel displays the whitest image. 256 gray levels represent 256 gray level values, where 0 represents the lowest gray level, that is, the gray level at which the display panel displays the darkest image, and 255 represents the highest gray level, that is, the gray level at which the display panel displays the whitest image. 1024 gray levels represent 1024 gray level values, where 0 represents the lowest gray level, that is, the gray level at which the display panel displays the darkest image, and 1023 represents the highest gray level, that is, the gray level at which the display panel displays the whitest image. Therefore, when the display panel has 64 gray levels or 256 gray levels or 1024 gray levels, the non-zero gray levels are the gray levels other than 0. In specific implementation, in the pixel compensation method provided by the embodiment of the present disclosure, the data voltage corresponding to the non-zero gray level may be a data voltage corresponding to the gray level value $$400 + \frac{1024(V_{th} - 0.25)}{15.75},$$

where $V_{th}$ is the threshold voltage of the driving transistor. However, in practical applications, the data voltages corresponding to the non-zero gray levels may also be other voltage values. This requires design based on the actual application environment and is not limited herein.

The display panel generally applies the data voltage to the pixel circuit in the sub-pixel through the data line. When the data voltage corresponding to the non-zero gray level is applied to the first sub-pixel column of the sub-pixels of the same color to be compensated in the $n^{th}$ row, in order to prevent the data line corresponding to the sub-pixel in the second sub-pixel column from being in a floating state, in a specific implementation, in the pixel compensation method provided in the embodiment of the present disclosure, when the data voltage corresponding to the non-zero gray level is applied to the first sub-pixel column of the sub-pixels of the same color to be compensated in the $n^{th}$ row, the compensation method may further include: applying a data voltage corresponding to a zero gray level to the second sub-pixel column of the sub-pixels of the same color to be compensated in the $n^{th}$ row, and controlling the pixel circuit in the second sub-pixel column to charge the coupled detection line. Thus, the data voltage corresponding to the zero gray level can be applied to the data line corresponding to the sub-pixel in the second sub-pixel column of the sub-pixels of the same color to be compensated in the $n^{th}$ row. Since the zero gray level corresponds to the darkest picture, the data voltage corresponding to the zero gray level generally does not cause an operating current to be generated by the driving transistor in the pixel circuit, so the data voltage corresponding to the zero gray level charges a voltage 0V to the detection line corresponding to the second sub-pixel column through the pixel circuit, which can ensure that no additional detection voltage is applied to the detection line corresponding to each sub-pixel in the second sub-pixel column.

In addition, when the data voltage corresponding to the non-zero gray level is applied to the second sub-pixel column of the sub-pixels of the same color to be compensated in the $n^{th}$ row, in order to prevent the data line corresponding to the sub-pixel in the first sub-pixel column from being in a floating state, when the data voltage corresponding to the non-zero gray level is applied to the second sub-pixel column of the sub-pixels of the same color to be compensated in the $n^{th}$ row, the compensation method may further include: applying the data voltage corresponding to the zero gray level to the first sub-pixel column of the sub-pixels of the same color to be compensated in the $n^{th}$ row, and controlling the pixel circuit in the first sub-pixel column to charge the coupled detection line. Thus, the data voltage corresponding to the zero gray level can be applied to the data line corresponding to the sub-pixel in the first sub-pixel column of the sub-pixels of the same color to be compensated in the $n^{th}$ row. Since the zero gray level corresponds to the darkest picture, the data voltage corresponding to the zero gray level generally does not cause an operating current to be generated by the driving transistor in the pixel circuit, so the data voltage corresponding to the zero gray level charges a voltage 0V to the detection line corresponding to the sub-pixel in the first sub-pixel column through the pixel circuit, which can ensure that no additional detection voltage is applied to the detection line corresponding to each sub-pixel in the first sub-pixel column.

In specific implementation, in the pixel compensation method provided by the embodiment of the present disclosure, the determining a detection voltage corresponding to the first sub-pixel column in the $n^{th}$ row according to a detected voltage may specifically include: according to the detected voltages on the detection lines corresponding to the sub-pixels of the same color to be compensated, calculating a voltage difference between voltages on the detection lines corresponding to two adjacent sub-pixels of the same color to be compensated in the $n^{th}$ row, to determine the detection voltage corresponding to the first sub-pixel column in the $n^{th}$ row.

In addition, the determining a detection voltage corresponding to the second sub-pixel column in the $n^{th}$ row according to a detected voltage may specifically include: according to the detected voltages on the detection lines corresponding to the sub-pixels of the same color to be compensated, calculating the voltage difference between the voltages on the detection lines corresponding to the two adjacent sub-pixels of the same color to be compensated in the $n^{th}$ row, to determine the detection voltage corresponding to the second sub-pixel column in the $n^{th}$ row.

In specific implementation, the pixel compensation method provided in the embodiment of the present disclosure further includes after the determining a detection voltage corresponding to the first sub-pixel column in the $n^{th}$ row, and before the determining a data voltage of each of the sub-pixels of the same color to be compensated in the $n^{th}$ row for the display frames after the $(2n)^{th}$ display frame:

storing the detection voltage corresponding to the first sub-pixel column in the $n^{th}$ row.

The pixel compensation method provided in the embodiment of the present disclosure further includes after the determining a detection voltage corresponding to the second sub-pixel column in the $n^{th}$ row, and before the determining a data voltage of each of the sub-pixels of the same color to be compensated in the $n^{th}$ row for the display frames after the $(2n)^{th}$ display frame: storing the detection voltage corresponding to the second sub-pixel column in the $n^{th}$ row.

In a specific implementation, in the pixel compensation method provided by the embodiment of the present disclosure, the data voltage of each of the sub-pixels of the same color to be compensated in the $n^{th}$ row for the display frames after the $(2n)^{th}$ display frame may be determined according to the detection voltage corresponding to each of the sub-pixels of the same color to be compensated in the $n^{th}$ row with a preset compensation algorithm. In specific implementation, the preset compensation algorithm is the same as the compensation algorithm in the related art, which can be understood by those skilled in the art, and will not be described here.

In specific implementation, in the pixel compensation method provided in the embodiment of the present disclosure, when the electroluminescent display panel includes N rows of sub-pixels, the compensation stage may include 2N consecutive display frames. The $(2n-1)^{th}$ display frame is the $(2n-1)^{th}$ display frame among the 2N consecutive display frames. The $(2n)^{th}$ display frame is the $(2n)^{th}$ display frame among the 2N consecutive display frames. In addition, when there are sub-pixels of M types of colors in the electroluminescent display panel, the compensation period may include the same number of compensation stages as the total number of color types. For example, when M=1, the compensation period may include only one compensation stage. When M=2, the compensation period may include two compensation stages, and the display frames in the two compensation stages are consecutive. That is, in the two compensation stages, the last display frame of the first compensation stage is next to the first display frame of the second compensation stage. When M=3, the compensation period may include three compensation stages, and the display frames in the three compensation stages are consecutive. That is, in the three compensation stages, the last display frame of the first compensation stage is next to the first display frame of the second compensation stage, and the last display frame of the second compensation stage is next to the first display frame of the third compensation stage. When M=4, the compensation period may include four compensation stages, and the display frames in the four compensation stages are consecutive. That is, in the four compensation stages, the last display frame of the first compensation stage is next to the first display frame of the second compensation stage, the last display frame of the second compensation stage is next to the first display frame of the third compensation stage, and the last display frame of the third compensation stage is next to the first display frame of the fourth compensation stage. When M is other value, the situation is similar, which will not be repeated herein.

In specific implementation, in the pixel compensation method provided by the embodiment of the present disclosure, the electroluminescent display panel may be a high resolution display panel. In practical applications, the high resolution may include: 3840×2160, 1920×1080, etc., which is not limited herein.

In specific implementation, as shown in FIG. 2*a*, the electroluminescent display panel may include a red sub-pixel P_1, a green sub-pixel P_2, and a blue sub-pixel P_3. In the pixel compensation method provided by the embodiment of the present disclosure, the compensation period may include three compensation stages that are sequentially arranged, and each compensation stage corresponds to the sub-pixels of the same color of the red sub-pixels P_1, the green sub-pixels P_2, and the blue sub-pixels P_3. In this case, the sub-pixels to be compensated in the three compensation stages may be in the order of the red sub-pixel P_1, the green sub-pixel P_2, and the blue sub-pixel P_3, such that the threshold voltages of the driving transistors in the sub-pixels of the electroluminescent display panel can be compensated in the order of red, green and blue within the compensation period. Alternatively, the sub-pixels to be compensated in the three compensation stages may also be in the order of the red sub-pixel P_1, the blue sub-pixel P_3, and the green sub-pixel P_2, such that the threshold voltages of the driving transistors in the sub-pixels of the electroluminescent display panel can be compensated in the order of red, blue and green within the compensation period. Alternatively, the sub-pixels to be compensated in the three compensation stages may also be in the order of the green sub-pixel P_2, the red sub-pixel P_1, and the blue sub-pixel P_3, such that the threshold voltages of the driving transistors in the sub-pixels of the electroluminescent display panel can be compensated in the order of green, red and blue within the compensation period. However, the sub-pixels to be compensated in the three compensation stages may also be in other sequence of the red sub-pixel P_1, the green sub-pixel P_2 and the blue sub-pixel P_3, which will not be described herein.

In specific implementation, as shown in FIG. 2*b*, the electroluminescent display panel may include a red sub-pixel P_1, a green sub-pixel P_2, a blue sub-pixel P_3 and a white sub-pixel P_4. In the pixel compensation method provided by the embodiment of the present disclosure, the compensation period may include four compensation stages that are sequentially arranged, and each compensation stage corresponds to the sub-pixels of the same color of the red sub-pixel P_1, the green sub-pixel P_2, the blue sub-pixel P_3 and the white sub-pixel P_4. In this case, the sub-pixels to be compensated in the four compensation stages may be in the order of the red sub-pixel P_1, the green sub-pixel P_2, the blue sub-pixel P_3 and the white sub-pixel P_4, such that the threshold voltages of the driving transistors in the sub-pixels of the electroluminescent display panel can be compensated in the order of red, green, blue and white within the compensation period. Alternatively, the sub-pixels to be compensated in the four compensation stages may also be in the order of the red sub-pixel P_1, the blue sub-pixel P_3, the green sub-pixel P_2 and the white sub-pixel P_4, such that the threshold voltages of the driving transistors in the sub-pixels of the electroluminescent display panel can be compensated in the order of red, blue, green and white within the compensation period. Alternatively, the sub-pixels to be compensated in the four compensation stages may also be in the order of the green sub-pixel P_2, the red sub-pixel P_1, the blue sub-pixel P_3 and the white sub-pixel P_4, such that the threshold voltages of the driving transistors in the sub-pixels of the electroluminescent display panel can be compensated in the order of green, red, blue and white within the compensation period. However, the sub-pixels to be compensated in the four compensation stages may also be in other sequence of the red sub-pixel P_1, the green sub-pixel P_2, and the blue sub-pixel P_3, which will not be described herein.

In the following, detailed description will be given to the pixel compensation method provided in the present disclosure, with reference to an example in which the first sub-pixel column is the odd column of the same color sub-pixels in the corresponding row, n=1, K=3840 and the to-be-compensated sub-pixel is a red sub-pixel.

The first sub-pixel column is an odd column of the same color sub-pixels in the corresponding row, and the second sub-pixel column is an even column of the same color sub-pixels in the corresponding row. The pixel compensation method provided in the present disclosure may include the following steps.

(1) In the compensation stage of the compensation period, in the blanking section of the first display frame, the detection line corresponding to the odd column of sub-pixels of the red sub-pixels in the first row is charged, a voltage on the detection line corresponding to each red sub-pixel in the first row is detected, and a detection voltage corresponding to the odd column of sub-pixels of the red sub-pixels in the first row is determined according to the detected voltage.

Figure 4A:
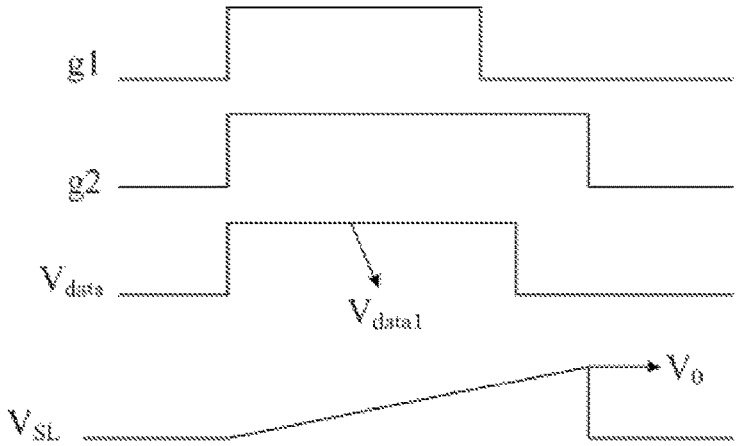
FIG. 4*a* is a first timing diagram according to an embodiment of the present disclosure.
Figure 4B:
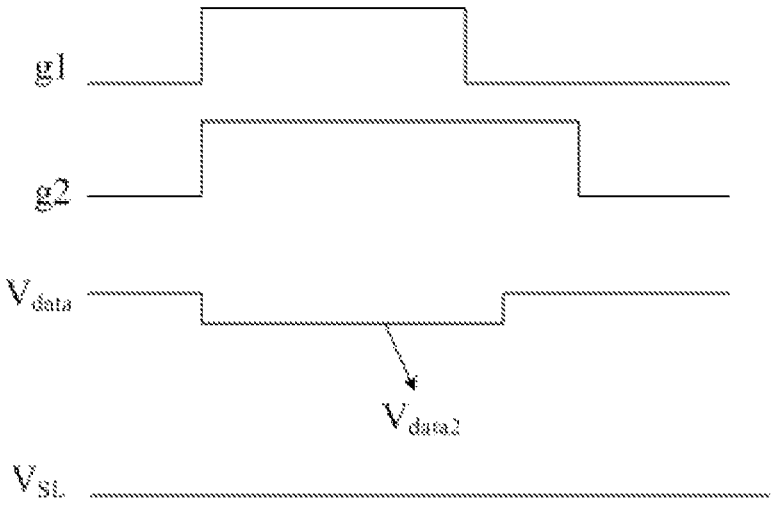
FIG. 4*b* is a second timing diagram according to an embodiment of the present disclosure.

Specifically, in the compensation stage of the compensation period, in the blanking section of the first display frame, a data voltage $V_{data1}$ corresponding to a non-zero gray level is applied to the odd column of sub-pixels of the red sub-pixels in the first row, and the pixel circuit in the odd column of sub-pixels of the red sub-pixels is controlled to charge the coupled detection line. The operation process of charging the coupled detection line by the pixel circuit will be described with reference to the pixel circuit shown in FIG. 1 and the timing diagram shown in FIG. 4*a*. In FIG. 4*a*, g1 represents the signal at the first scan signal terminal G1, g2 represents signal at second scan signal terminal G2, $V_{data}$ represents the data voltage at the data signal terminal Data, and $V_{SL}$ represents the voltage charged into the detection line. The switching transistor T2 is turned on under the control of the high-level signal g1 at the first scan signal terminal G1, and the detection transistor T3 is turned on under the control of the high-level signal g2 at the second scan signal terminal G2. The switching transistor T2 supplies the input data voltage $V_{data1}$ to the gate electrode of the driving transistor T1. The driving transistor T1 generates the operating current I under the common control of the gate voltage and the source voltage thereof, and the operating current I satisfies the formula: $I=K[V_{gs}-V_{th}]^2=K[V_{data1}-V_{SL}-V_{th}]^2$. Since the OLED has a higher resistance than the detection line, the operating current I generated by the driving transistor T1 dominantly flows to the detection line SL to charge the detection line SL with the detection voltage $V_0$. Similarly, as shown in the timing diagram shown in FIG. 4*b*, in FIG. 4*b*, g1 represents the signal at the first scan signal terminal G1, g2 represents the signal at the second scan signal terminal G2, $V_{data}$ represents the data voltage at the data signal terminal Data, and $V_{SL}$ represents the voltage charged into the detection line. A data voltage $V_{data2}$ corresponding to a non-zero gray level is applied to the even column of sub-pixels of the red sub-pixels in the first row. The switching transistor T2 is turned on under the control of the high-level signal g1 at the first scan signal terminal G1, and the detection transistor T3 is turned on under the control of the high-level signal g2 at the second scan signal terminal G2. The switching transistor T2 supplies the input data voltage $V_{data}$2 to the gate electrode of the driving transistor T1. The driving transistor T1 does not generate the operating current I under the common control of the gate voltage and the source voltage thereof, to charge the detection line with a voltage 0 V.

The voltage $V_{SLk_1}$ on the detection line corresponding to each red sub-pixel in the first row is detected, to obtain $V_{SL1_1}=V_0+\Delta V$, $V_{SL2_1}=\Delta V$, $V_{SL3_1}=V_0+\Delta V$, $V_{SL4_1}=\Delta V$, . . . , $V_{SL3839_1}=V_0+\Delta V$, and $V_{SL3840_1}=\Delta V$. According to the detected voltage $V_{SLk_1}$ on the detection line corresponding to each red sub-pixel, a voltage difference $\Delta V_{SL2i-1_1}$ between voltages $V_{SLk_1}$ on the detection lines corresponding to two adjacent red sub-pixels in the first row is calculated, that is, a voltage difference $\Delta V_{SL2i-1_1}$ between the voltage $V_{SL2i-1_1}$ on the detection line corresponding to the $(2i-1)^{th}$ column of red sub-pixels and the voltage $V_{SL2i_1}$ on the detection line corresponding to the $(2i)^{th}$ column of red sub-pixels is calculated, to obtain $\Delta V_{SL1_1}=V_{SL1_1}-V_{SL2_1}=V_0$, $\Delta V_{SL3_1}=V_{SL3_1}-V_{SL4_1}=V_0$, . . . . , $\Delta V_{SL3839_1}=V_{SL3839_1}-V_{SL3840_1}=V_0$. In this way, the detection voltage $V_0$ corresponding to the odd column of sub-pixels of the red sub-pixels in the first row, with the coupling voltage $\Delta V$ eliminated, can be obtained, and 1920 detection voltages $V_0$ can be obtained. The 1920 detection voltages $V_0$ are stored.

(2) In the blanking section of the second display frame, the detection line corresponding to the even column of sub-pixels of the red sub-pixels in the first row is charged, a voltage on the detection line corresponding to each red sub-pixel in the first row is detected, and a detection voltage corresponding to the even column of sub-pixels of the red sub-pixels in the first row is determined according to the detected voltage.

Specifically, in the blanking section of the second display frame, the data voltage $V_{data1}$ corresponding to the non-zero gray level is applied to the even column of sub-pixels of the red sub-pixels in the first row, and the pixel circuit in the even column of sub-pixels of the red sub-pixels is controlled to charge the coupled detection line. The operation process of charging the coupled detection line by the pixel circuit will be described with reference to the pixel circuit shown in FIG. 1 and the timing diagram shown in FIG. 4*a*. The switching transistor T2 is turned on under the control of the high-level signal g1 at the first scan signal terminal G1, and the detection transistor T3 is turned on under the control of the high-level signal g2 at the second scan signal terminal G2. The switching transistor T2 supplies the input data voltage $V_{data}$i to the gate electrode of the driving transistor T1. The driving transistor T1 generates the operating current I under the common control of the gate voltage and the source voltage thereof, and the operating current I satisfies the formula: $I=K[V_{gs}-V_h]^2=K[V_{data1}-V_{SL}-V_{th}]^2$. Since the OLED has a higher resistance than the detection line, the operating current I generated by the driving transistor T1 dominantly flows to the detection line SL to charge the detection line SL with the detection voltage $V_0$. Similarly, as shown in the timing diagram shown in FIG. 4*b*, a data voltage $V_{data2}$ corresponding to a zero gray level is applied to the odd column of sub-pixels of the red sub-pixels in the first row, and the pixel circuit in the odd column of sub-pixels of the red sub-pixels is controlled to charge the detection line with a voltage of 0V.

The voltage $V_{SLk_1}$ on the detection line corresponding to each red sub-pixel in the first row is detected, to obtain $V_{SL1_1}=\Delta V$, $V_{SL2_1}=V_0+\Delta V$, $V_{SL3_1}=\Delta V$, $V_{SL4_1}=V_0+\Delta V$, . . . $V_{SL3839_1}=\Delta V$, and $V_{SL3840_1}=V_0+\Delta V$. According to the detected voltage $V_{SLk_1}$ on the detection line corresponding to each red sub-pixel, a voltage difference $\Delta V_{SL2i_1}$ between voltages $V_{SLk_1}$ on the detection lines corresponding to two adjacent red sub-pixels in the first row is calculated, that is, a voltage difference $\Delta V_{SL2i_1}$ between the voltage $V_{SL2i_1}$ the detection line corresponding to the $(2i)^{th}$ column of red sub-pixels and the voltage $\Delta V_{SL2i-1_1}$ ion the detection line corresponding to the $(2i-1)^{th}$ column of red sub-pixels is calculated, to obtain $V_{SL2_1}=V_{SL2_1}-V_{SL1_1}=V_0$, $\Delta V_{SL4_1}=V_{SL4_1}-V_{SL3_1}=V_0$, . . . , $\Delta V_{SL3840_1}=V_{SL3840_1}-V_{SL3839_1}=V_0$. In this way, the detection voltage $V_0$ corresponding to the even column of sub-pixels of the red sub-pixels in the first row, with the coupling voltage $\Delta V$ eliminated, can be obtained, and 1920 detection voltages $V_0$ can be obtained. The 1920 detection voltages $V_0$ are stored.

(3) A data voltage of each red sub-pixel in the first row for the display frames after the $(2n)^{th}$ display frame is determined according to the detection voltage corresponding to each red sub-pixel in the first row through a preset compensation algorithm.

Specifically, according to the formula IT=CV, T represents the time taken for charging the detection line with the voltage V, C represents the capacitance value of the storage capacitor coupled to the detection line, and V represents the voltage value which is changed after the detection line is charged. According to the above formula, the operating current I generated by the driving transistor can be calculated according to the detection voltage $V_0$, and then the relationship between the input data voltage and the threshold voltage $V_{th}$ and the mobility of the driving transistor can be obtained according to the calculated operating current I. The data voltage of each red sub-pixel in the first row for the display frames after the second display frame is determined for the compensation according to the determined relationship between the data voltage and the threshold voltage $V_{th}$ and the mobility of the driving transistor, and the display frames after the second display frame are displayed with the determined data voltage for compensation, to improve the display effect.

In practical applications, the above compensation method generally uses a device combining software and hardware to achieve its function. In the electroluminescent display panel, one storage capacitor corresponding to each detection line is also provided in advance. One terminal of the storage capacitor is coupled to the corresponding detection line and the above-mentioned device combining software and hardware, and the other terminal of the storage capacitor is grounded. The capacitance value C of the storage capacitor is a value that has been preset in advance in the process of manufacturing the organic display panel, and T is a preset charging time, and the charging time T is the same for each sub-pixel.

Similarly, when the first sub-pixel column is an even column of the same color sub-pixels in the corresponding row, and the second sub-pixel column is an odd column of the same color sub-pixels in the corresponding row, the operation process of the pixel compensation method provided by the present disclosure can refer to the above embodiment, only with that the odd column of sub-pixels in the above embodiment is changed into even column of sub-pixels, and the even column of sub-pixels is changed into odd column of sub-pixels. The detailed process is not described here.

Based on the same inventive concept, an embodiment of the present disclosure further provides a pixel compensation apparatus for compensation of pixels in an electroluminescent display panel. As shown in FIGS. 2*a* and 2*b*, the electroluminescent display panel 10 includes a plurality of pixels PX and a plurality of detection lines SL_k, each column of the pixels corresponds to one of the detection lines, each of the pixels PX includes a plurality of sub-pixels P_m of different colors, respective sub-pixels P_m in a same pixel PX are coupled to a same detection line, the sub-pixels of a same color in each row are divided into a first sub-pixel column and a second sub-pixel column that are alternately arranged, the first sub-pixel column is one of an odd column of the sub-pixels of the same color in the row and an even column of the sub-pixels of the same color in the row.

The pixel compensation apparatus includes:

a first detection determining circuit 20, configured to, in a compensation stage of a compensation period, in a blanking section of a $(2n-1)^{th}$ display frame, charge the detection line corresponding to the first sub-pixel column of the sub-pixels of the same color to be compensated in a $n^{th}$ row, detect a voltage on the detection line corresponding to each of the sub-pixels of the same color to be compensated in the $n^{th}$ row, and determine a detection voltage corresponding to the first sub-pixel column in the $n^{th}$ row according to a detected voltage, where n is an integer greater than or equal to 1 and less than or equal to N, and N is a number of rows of the sub-pixels of the same color to be compensated in the electroluminescent display panel 10;

a second detection determining circuit 30, configured to, in the blanking section of a $(2n)^{th}$ display frame, charge the detection line corresponding to the second sub-pixel column of the sub-pixels of the same color to be compensated in the $n^{th}$ row, detect the voltage on the detection line corresponding to each of the sub-pixels of the same color to be compensated in the $n^{th}$ row, and determine a detection voltage corresponding to the second sub-pixel column in the $n^{th}$ row according to a detected voltage; and a data determining circuit 40, configured to determine a data voltage of each of the sub-pixels of the same color to be compensated in the $n^{th}$ row for display frames after the $(2n)^{th}$ display frame according to the detection voltage corresponding to each of the sub-pixels of the same color to be compensated in the $n^{th}$ row.

The pixel compensation apparatus provided by the embodiment of the present disclosure is applied to compensate the pixels in the electroluminescent display panel. In the blanking section of the $(2n-1)^{th}$ display frame of the compensation stage of the compensation period, the detection line corresponding to the first sub-pixel column of sub-pixels of the same color to be compensated in the $n^{th}$ row is charged with an additional detection voltage $V_0$, such that the detected voltage on the detection line corresponding to the first sub-pixel column is the sum of the detection voltage $V_0$ and a coupling voltage $\Delta V$ caused by coupling that is, $V_0+\Delta V$. In the blanking section of the $(2n-1)^{th}$ display frame, the detection line corresponding to the second sub-pixel column of the sub-pixels of the same color to be compensated is not charged with the additional detection voltage $V_0$, such that the detected voltage on the detection line corresponding to the second sub-pixel column is only the coupling voltage $\Delta V$. Then, it is possible to obtain the detection voltage $V_0$ corresponding to each sub-pixel in the first sub-pixel column according to the voltages on the detection lines corresponding to the sub-pixels of the same color to be compensated. Similarly, in the blanking section of the $(2n)^{th}$ display frame, the detection line corresponding to the second sub-pixel column of the sub-pixels of the same color to be compensated in the $n^{th}$ row is charged with the additional detection voltage $V_0$, such that the detected voltage on the detection line corresponding to the second sub-pixel column is $V_0+\Delta V$. In the blanking section of the $(2n)^{th}$ display frame, the detection line corresponding to the first sub-pixel column of the sub-pixels of the same color to be compensated is not charged with the additional detection voltage $V_0$, such that the detected voltage on the detection line corresponding to the first sub-pixel column is only the coupling voltage $\Delta V$. Then, it is possible to obtain the detection voltage $V_0$ corresponding to each sub-pixel in the second sub-pixel column according to the voltages on the detection lines corresponding to the sub-pixels of the same color to be compensated. In this way, the detection voltage $V_0$ corresponding to each sub-pixel of the same color to be compensated in the $n^{th}$ row can be obtained, therefore the influence of the coupling action on the detection voltage $V_0$ may be eliminated, and the accuracy of the detected voltage corresponding to each sub-pixel of the same color to be compensated is improved. Therefore, the problem that the data voltage obtained by the compensation calculation is inaccurate due to the voltage change on the detection line caused by the coupling action can be avoided, and the display effect of the screen can be improved.

In specific implementation, in the pixel compensation apparatus provided in the embodiment of the present disclosure, the sub-pixel in the electroluminescent display panel may specifically include a pixel circuit and a light emitting device coupled to the pixel circuit, and the pixel circuit is coupled to a corresponding detection line. The light emitting device may be an organic light emitting diode; alternatively, the light emitting device may also be a quantum dot light emitting diode. However, the light emitting device may also be another type of electroluminescent diode capable of emitting light by itself, which is not limited herein.

The first detection determining circuit is specifically configured to apply a data voltage corresponding to a non-zero gray level to the first sub-pixel column of the sub-pixels of the same color to be compensated in the $n^{th}$ row, and control the pixel circuit in the first sub-pixel column to charge the detection line.

In addition, the second detection determining circuit is specifically configured to apply the data voltage corresponding to the non-zero gray level to the second sub-pixel column of the sub-pixels of the same color to be compensated in the $n^{th}$ row, and control the pixel circuit in the second sub-pixel column to charge the detection line.

In specific implementation, in the pixel compensation apparatus provided in the embodiment of the present disclosure, the first detection determining circuit is further configured to apply a data voltage corresponding to a zero gray level to the second sub-pixel column of the sub-pixels of the same color to be compensated in the $n^{th}$ row, and control the pixel circuit in the second sub-pixel column to charge the detection line.

In addition, the second detection determining circuit is further configured to apply the data voltage corresponding to the zero gray level to the first sub-pixel column of the sub-pixels of the same color to be compensated in the $n^{th}$ row, and control the pixel circuit in the first sub-pixel column to charge the detection line.

In specific implementation, in the pixel compensation apparatus provided in the embodiment of the present disclosure, the first detection determining circuit is specifically configured to, according to the detected voltages on the detection lines corresponding to the sub-pixels of the same color to be compensated, calculate a voltage difference between voltages on the detection lines corresponding to two adjacent sub-pixels of the same color to be compensated in the $n^{th}$ row, to determine the detection voltage corresponding to the first sub-pixel column in the $n^{th}$ row.

In addition, the second detection determining circuit is specifically configured to, according to the detected voltages on the detection lines corresponding to the sub-pixels of the same color to be compensated, calculate the voltage difference between the voltages on the detection lines corresponding to the two adjacent sub-pixels of the same color to be compensated in the $n^{th}$ row, to determine the detection voltage corresponding to the second sub-pixel column in the $n^{th}$ row.

In specific implementation, in the pixel compensation apparatus provided in the embodiment of the present disclosure, the first detection determining circuit may include a first processor, and the first processor may adopt a combination of software and hardware to achieve the function to be performed by the first detection determining circuit. The second detection determining circuit may include a second processor, and the second processor may adopt a combination of software and hardware to achieve the function to be performed by the second detection determining circuit. The data determining circuit may include a third processor, and the third processor may adopt a combination of software and hardware to achieve the function to be performed by the data determining circuit. A storage capacitor corresponding to each detection line is also pre-arranged in the electroluminescent display panel. One terminal of the storage capacitor is coupled to the corresponding detection line, the first processor and the second processor, and the other terminal of the storage capacitor is grounded. However, the first detection determining circuit, the second detection determining circuit, and the data determining circuit may all be provided in a processor that combines software and hardware to achieve high integration. In this case, one terminal of the storage capacitor in the electroluminescent display panel is coupled to the corresponding detection line and the processor. The other terminal of the storage capacitor is grounded.

In a specific implementation, in the pixel compensation apparatus provided by the embodiment of the present disclosure, the pixel compensation apparatus further includes: a first storage circuit configured to store the detection voltage corresponding to the first sub-pixel column in the $n^{th}$ row; and a second storage circuit configured to store the detection voltage corresponding to the second sub-pixel column in the $n^{th}$ row.

In specific implementation, in the pixel compensation apparatus provided by the embodiment of the present disclosure, the first storage circuit may include a first storage, and the first storage may adopt a combination of software and hardware to achieve the function of storing the determined detection voltage corresponding to the first sub-pixel column in the $n^{th}$ row. The second storage circuit may include a second storage, and the second storage may adopt a combination of software and hardware to achieve the function of storing the determined detection voltage corresponding to the second sub-pixel column in the $n^{th}$ row. However, the first storage circuit and the second storage circuit may both be disposed in a storage that combines software and hardware to achieve high integration.

In specific implementation, as shown in FIG. 2*a*, the electroluminescent display panel may include a red sub-pixel P_1, a green sub-pixel P_2, and a blue sub-pixel P_3. In the pixel compensation apparatus provided by the embodiment of the present disclosure, the compensation period may include three compensation stages that are sequentially arranged, and each compensation stage corresponds to the sub-pixels of the same color of the red sub-pixels P_1, the green sub-pixels P_2, and the blue sub-pixels P_3. In this case, the sub-pixels to be compensated in the three compensation stages may be in the order of the red sub-pixel P_1, the green sub-pixel P_2, and the blue sub-pixel P_3, such that the threshold voltages of the driving transistors in the sub-pixels of the electroluminescent display panel can be compensated in the order of red, green and blue within the compensation period. Alternatively, the sub-pixels to be compensated in the three compensation stages may also be in the order of the red sub-pixel P_1, the blue sub-pixel P_3, and the green sub-pixel P_2, such that the threshold voltages of the driving transistors in the sub-pixels of the electroluminescent display panel can be compensated in the order of red, blue and green within the compensation period. Alternatively, the sub-pixels to be compensated in the three compensation stages may also be in the order of the green sub-pixel P_2, the red sub-pixel P_1, and the blue sub-pixel P_3, such that the threshold voltages of the driving transistors in the sub-pixels of the electroluminescent display panel can be compensated in the order of green, red and blue within the compensation period. However, the sub-pixels to be compensated in the three compensation stages may also be in other sequence of the red sub-pixel P_1, the green sub-pixel P_2 and the blue sub-pixel P_3, which will not be described herein.

In specific implementation, as shown in FIG. 2*b*, the electroluminescent display panel may include a red sub-pixel P_1, a green sub-pixel P_2, a blue sub-pixel P_3 and a white sub-pixel P_4. In the pixel compensation apparatus provided by the embodiment of the present disclosure, the compensation period may include four compensation stages that are sequentially arranged, and each compensation stage corresponds to the sub-pixels of the same color of the red sub-pixel P_1, the green sub-pixel P_2, the blue sub-pixel P_3 and the white sub-pixel P_4. In this case, the sub-pixels to be compensated in the four compensation stages may be in the order of the red sub-pixel P_1, the green sub-pixel P_2, the blue sub-pixel P_3 and the white sub-pixel P_4, such that the threshold voltages of the driving transistors in the sub-pixels of the electroluminescent display panel can be compensated in the order of red, green, blue and white within the compensation period. Alternatively, the sub-pixels to be compensated in the four compensation stages may also be in the order of the red sub-pixel P_1, the blue sub-pixel P_3, the green sub-pixel P_2 and the white sub-pixel P_4, such that the threshold voltages of the driving transistors in the sub-pixels of the electroluminescent display panel can be compensated in the order of red, blue, green and white within the compensation period. Alternatively, the sub-pixels to be compensated in the four compensation stages may also be in the order of the green sub-pixel P_2, the red sub-pixel P_1, the blue sub-pixel P_3 and the white sub-pixel P_4, such that the threshold voltages of the driving transistors in the sub-pixels of the electroluminescent display panel can be compensated in the order of green, red, blue and white within the compensation period. However, the sub-pixels to be compensated in the four compensation stages may also be in other sequence of the red sub-pixel P_1, the green sub-pixel P_2, and the blue sub-pixel P_3, which will not be described herein.

It should be noted that the size and shape of each graphic in the above drawings do not reflect the true ratio between the pixel compensation apparatus and the electroluminescent display panel, and the purpose is only to schematically illustrate the content of the present disclosure.

In specific implementation, in the pixel compensation apparatus provided by the embodiment of the present disclosure, the data determining circuit may be specifically configured to determine the data voltage of each of the sub-pixels of the same color to be compensated in the $n^{th}$ row for the display frames after the $(2n)^{th}$ display frame according to the detection voltage corresponding to each of the sub-pixels of the same color to be compensated in the $n^{th}$ row with a preset compensation algorithm. In specific implementation, the preset compensation algorithm is the same as the compensation algorithm in the related art, which can be understood by those skilled in the art, and will not be described here.

Generally, the electroluminescent display panel further includes a source driving circuit. In a specific implementation, in the pixel compensating apparatus provided by the embodiment of the present disclosure, the data determining circuit is configured to provide the determined data voltage of each of the sub-pixels of the same color to be compensated in the $n^{th}$ row for the display frames after the $(2n)^{th}$ display frame to the source driving circuit, and control the source driving circuit to apply the data voltage to the corresponding sub-pixel for the display frame after the $(2n)^{th}$ display frame, to compensate the threshold voltage and the mobility of the driving transistor in the pixel circuit of the sub-pixel.

Based on the same inventive concept, an embodiment of the present disclosure further provides a display device including the above-mentioned pixel compensation apparatus provided by the embodiment of the present disclosure. For the implementation of the display device, please refer to the embodiment of the pixel compensation apparatus described above, and the repeated description is omitted.

In specific implementation, the display device provided by the embodiment of the present disclosure further includes an electroluminescent display panel. The electroluminescent display panel may be an organic light emitting display panel; or the electroluminescent display panel may also be a quantum dot light emitting display panel, which is not limited herein.

In specific implementation, the display device provided by the embodiment of the present disclosure may be any product or component having a display function such as a mobile phone, a tablet computer, a television, a monitor, a notebook computer, a digital photo frame, a navigator, and the like. Other essential components of the display device are understood by those of ordinary skill in the art, which are not described herein, and should not be construed as limiting the present disclosure.

In the pixel compensation method, the pixel compensation apparatus and the display device provided by the embodiment of the present disclosure, in the blanking section of the $(2n-1)^{th}$ display frame of the compensation stage of the compensation period, the detection line corresponding to the first sub-pixel column of sub-pixels of the same color to be compensated in the $n^{th}$ row is charged with an additional detection voltage $V_0$, such that the detected voltage on the detection line corresponding to the first sub-pixel column is the sum of the detection voltage $V_0$ and a coupling voltage $\Delta V$ caused by coupling that is, $V_0+\Delta V$. In the blanking section of the $(2n-1)^{th}$ display frame, the detection line corresponding to the second sub-pixel column of the sub-pixels of the same color to be compensated is not charged with the additional detection voltage $V_0$, such that the detected voltage on the detection line corresponding to the second sub-pixel column is only the coupling voltage $\Delta V$. Then, it is possible to obtain the detection voltage $V_0$ corresponding to each sub-pixel in the first sub-pixel column according to the voltages on the detection lines corresponding to the sub-pixels of the same color to be compensated.

Similarly, in the blanking section of the $(2n)^{th}$ display frame, the detection line corresponding to the second sub-pixel column of the sub-pixels of the same color to be compensated in the $n^{th}$ row is charged with the additional detection voltage $V_0$, such that the detected voltage on the detection line corresponding to the second sub-pixel column is $V_0+\Delta V$. In the blanking section of the $(2n)^{th}$ display frame, the detection line corresponding to the first sub-pixel column of the sub-pixels of the same color to be compensated is not charged with the additional detection voltage $V_0$, such that the detected voltage on the detection line corresponding to the first sub-pixel column is only the coupling voltage $\Delta V$. Then, it is possible to obtain the detection voltage $V_0$ corresponding to each sub-pixel in the second sub-pixel column according to the voltages on the detection lines corresponding to the sub-pixels of the same color to be compensated. In this way, the detection voltage $V_0$ corresponding to each sub-pixel of the same color to be compensated in the $n^{th}$ row can be obtained, therefore the influence of the coupling action on the detection voltage $V_0$ may be eliminated, and the accuracy of the detected voltage corresponding to each sub-pixel of the same color to be compensated is improved. Therefore, the problem that the data voltage obtained by the compensation calculation is inaccurate due to the voltage change on the detection line caused by the coupling action can be avoided, and the display effect of the screen can be improved.

It will be apparent to those skilled in the art that various modifications and variations can be made in the present disclosure without departing from the spirit and scope of the present disclosure. Thus, if these modifications and variations of the present disclosure fall within the scope of the claims of the present disclosure and their equivalents, the present disclosure is also intended to include these modifications and variations.

What is claimed is:

1. A pixel compensation method for compensation of pixels in an electroluminescent display panel, wherein the electroluminescent display panel comprises a plurality of pixels and a plurality of detection lines, each column of the pixels corresponds to one of the detection lines, each of the pixels comprises a plurality of sub-pixels of different colors, respective sub-pixels in a same pixel are coupled to a same detection line, the sub-pixels of a same color in each row are divided into a first sub-pixel column and a second sub-pixel column that are alternately arranged, the first sub-pixel column is one of an odd column of the sub-pixels of the same color in the row and an even column of the sub-pixels of the same color in the row, the pixel compensation method comprising:

in a compensation stage of a compensation period, in a blanking section of a $(2n-1)^{th}$ display frame, charging the detection line corresponding to the first sub-pixel column of the sub-pixels of the same color to be compensated in a $n^{th}$ row, detecting a resulting voltage on the detection line corresponding to each of the sub-pixels of the same color to be compensated in the $n^{th}$ row, and determining a detection voltage corresponding to the first sub-pixel column in the $n^{th}$ row according to the resulting voltage, where n is an integer greater than or equal to 1 and less than or equal to N, and N is a number of rows of the sub-pixels of the same color to be compensated in the electroluminescent display panel;

in the blanking section of a $(2n)^{th}$ display frame, charging the detection line corresponding to the second sub-pixel column of the sub-pixels of the same color to be compensated in the $n^{th}$ row, detecting the resulting voltage on the detection line corresponding to each of the sub-pixels of the same color to be compensated in the $n^{th}$ row, and determining the detection voltage corresponding to the second sub-pixel column in the $n^{th}$ row according to the resulting voltage; and determining a data voltage of each of the sub-pixels of the same color to be compensated in the $n^{th}$ row for display frames after the $(2n)^{th}$ display frame according to the detection voltage corresponding to each of the sub-pixels of the same color to be compensated in the $n^{th}$ row.

2. The pixel compensation method according to claim 1, wherein the sub-pixel comprises a pixel circuit and a light emitting device coupled to the pixel circuit, and the pixel circuit is coupled to a corresponding detection line, and wherein the step of charging the detection line corresponding to the first sub-pixel column of the sub-pixels of the same color to be compensated in a $n^{th}$ row comprises: applying the data voltage corresponding to a non-zero gray level to the first sub-pixel column of the sub-pixels of the same color to be compensated in the $n^{th}$ row, and controlling the pixel circuit in the first sub-pixel column to charge the detection line; and the step of charging the detection line corresponding to the second sub-pixel column of the sub-pixels of the same color to be compensated in the $n^{th}$ row comprises: applying the data voltage corresponding to the non-zero gray level to the second sub-pixel column of the sub-pixels of the same color to be compensated in the $n^{th}$ row, and controlling the pixel circuit in the second sub-pixel column to charge the detection line.

3. The pixel compensation method according to claim 2, further comprising:

when applying the data voltage corresponding to the non-zero gray level to the first sub-pixel column of the sub-pixels of the same color to be compensated in the $n^{th}$ row, applying the data voltage corresponding to a zero gray level to the second sub-pixel column of the sub-pixels of the same color to be compensated in the $n^{th}$ row, and controlling the pixel circuit in the second sub-pixel column to charge the detection line; and when applying the data voltage corresponding to the non-zero gray level to the second sub-pixel column of the sub-pixels of the same color to be compensated in the $n^{th}$ row, applying the data voltage corresponding to the zero gray level to the first sub-pixel column of the sub-pixels of the same color to be compensated in the $n^{th}$ row, and controlling the pixel circuit in the first sub-pixel column to charge the detection line.

4. The pixel compensation method according to claim 1, wherein, the step of determining a detection voltage corresponding to the first sub-pixel column in the $n^{th}$ row according to the resulting voltage comprises: according to the resulting voltages on the detection lines corresponding to the sub-pixels of the same color to be compensated, calculating a voltage difference between voltages on the detection lines corresponding to two adjacent sub-pixels of the same color to be compensated in the $n^{th}$ row, to determine the detection voltage corresponding to the first sub-pixel column in the $n^{th}$ row; and the step of determining the detection voltage corresponding to the second sub-pixel column in the $n^{th}$ row according to the resulting voltage comprises: according to the resulting voltages on the detection lines corresponding to the sub-pixels of the same color to be compensated, calculating the voltage difference between the voltages on the detection lines corresponding to the two adjacent sub-pixels of the same color to be compensated in the $n^{th}$ row, to determine the detection voltage corresponding to the second sub-pixel column in the $n^{th}$ row.

5. The pixel compensation method according to of claim 1, further comprising: after the determining the detection voltage corresponding to the first sub-pixel column in the $n^{th}$ row, and before the determining the data voltage of each of the sub-pixels of the same color to be compensated in the $n^{th}$ row for the display frames after the $(2n)^{th}$ display frame: storing the detection voltage corresponding to the first sub-pixel column in the $n^{th}$ row; and after the determining the detection voltage corresponding to the second sub-pixel column in the $n^{th}$ row, and before the determining the data voltage of each of the sub-pixels of the same color to be compensated in the $n^{th}$ row for the display frames after the $(2n)^{th}$ display frame: storing the detection voltage corresponding to the second sub-pixel column in the $n^{th}$ row.

6. The pixel compensation method according to claim 1, wherein the electroluminescent display panel comprises a red sub-pixel, a green sub-pixel and a blue sub-pixel, the compensation period comprises three compensation stages arranged in sequence, and each of the compensation stages corresponds to one of the red sub-pixel, the green sub-pixel and the blue sub-pixel.

7. The pixel compensation method according to claim 1, wherein the electroluminescent display panel comprises a red sub-pixel, a green sub-pixel, a blue sub-pixel and a white sub-pixel, the compensation period comprises four compensation stages arranged in sequence, and each of the compensation stages corresponds to one of the red sub-pixel, the green sub-pixel, the blue sub-pixel and the white sub-pixel.

8. The pixel compensation method according to claim 6, wherein the sub-pixels to be compensated in the three compensation stages are in the order of the red sub-pixel, the green sub-pixel and the blue sub-pixel.

9. The pixel compensation method according to claim 7, wherein the sub-pixels to be compensated in the four compensation stages are in the order of the red sub-pixel, the green sub-pixel, the blue sub-pixel and the white sub-pixel.

10. A pixel compensation apparatus for compensation of pixels in an electroluminescent display panel, wherein the electroluminescent display panel comprises a plurality of pixels and a plurality of detection lines, each column of the pixels corresponds to one of the detection lines, each of the pixels comprises a plurality of sub-pixels of different colors, respective sub-pixels in a same pixel are coupled to a same detection line, the sub-pixels of a same color in each row are divided into a first sub-pixel column and a second sub-pixel column that are alternately arranged, the first sub-pixel column is one of an odd column of the sub-pixels of the same color in the row and an even column of the sub-pixels of the same color in the row, the pixel compensation apparatus comprising:

a first detection determining circuit, configured to, in a compensation stage of a compensation period, in a blanking section of a $(2n-1)^{th}$ display frame, charge the detection line corresponding to the first sub-pixel column of the sub-pixels of the same color to be compensated in a $n^{th}$ row, to detect a resulting voltage on the detection line corresponding to each of the sub-pixels of the same color to be compensated in the $n^{th}$ row, and to determine a detection voltage corresponding to the first sub-pixel column in the $n^{th}$ row according to the resulting voltage, where n is an integer greater than or equal to 1 and less than or equal to N, and N is a number of rows of the sub-pixels of the same color to be compensated in the electroluminescent display panel;

a second detection determining circuit, configured to, in the blanking section of a $(2n)^{th}$ display frame, charge the detection line corresponding to the second sub-pixel column of the sub-pixels of the same color to be compensated in the $n^{th}$ row, to detect the resulting voltage on the detection line corresponding to each of the sub-pixels of the same color to be compensated in the $n^{th}$ row, and to determine the detection voltage corresponding to the second sub-pixel column in the $n^{th}$ row according to the resulting voltage; and a data determining circuit, configured to determine a data voltage of each of the sub-pixels of the same color to be compensated in the $n^{th}$ row for display frames after the $(2n)^{th}$ display frame according to the detection voltage corresponding to each of the sub-pixels of the same color to be compensated in the $n^{th}$ row.

11. The pixel compensation apparatus according to claim 10, wherein the sub-pixel comprises a pixel circuit and a light emitting device coupled to the pixel circuit, and the pixel circuit is coupled to a corresponding detection line, and wherein the first detection determining circuit is configured to apply the data voltage corresponding to a non-zero gray level to the first sub-pixel column of the sub-pixels of the same color to be compensated in the $n^{th}$ row, and to control the pixel circuit in the first sub-pixel column to charge the detection line; and the second detection determining circuit is configured to apply the data voltage corresponding to the non-zero gray level to the second sub-pixel column of the sub-pixels of the same color to be compensated in the $n^{th}$ row, and to control the pixel circuit in the second sub-pixel column to charge the detection line.

12. The pixel compensation apparatus according to claim 11, wherein the first detection determining circuit is further configured to apply the data voltage corresponding to a zero gray level to the second sub-pixel column of the sub-pixels of the same color to be compensated in the $n^{th}$ row, and to control the pixel circuit in the second sub-pixel column to charge the detection line; and the second detection determining circuit is further configured to apply the data voltage corresponding to the zero gray level to the first sub-pixel column of the sub-pixels of the same color to be compensated in the $n^{th}$ row, and to control the pixel circuit in the first sub-pixel column to charge the detection line.

13. The pixel compensation apparatus according to claim 10, wherein, the first detection determining circuit is configured to: according to the resulting voltages on the detection lines corresponding to the sub-pixels of the same color to be compensated, calculate a voltage difference between voltages on the detection lines corresponding to two adjacent sub-pixels of the same color to be compensated in the $n^{th}$ row, to determine the detection voltage corresponding to the first sub-pixel column in the $n^{th}$ row; and the second detection determining circuit is configured to: according to the resulting voltages on the detection lines corresponding to the sub-pixels of the same color to be compensated, calculate the voltage difference between the voltages on the detection lines corresponding to the two adjacent sub-pixels of the same color to be compensated in the $n^{th}$ row, to determine the detection voltage corresponding to the second sub-pixel column in the $n^{th}$ row.

14. The pixel compensation apparatus according to claim 10, further comprising:

a first storage circuit configured to store the detection voltage corresponding to the first sub-pixel column in the $n^{th}$ row; and a second storage circuit configured to store the detection voltage corresponding to the second sub-pixel column in the $n^{th}$ row.

15. The pixel compensation apparatus according to claim 10, wherein the electroluminescent display panel comprises a red sub-pixel, a green sub-pixel and a blue sub-pixel, the compensation period comprises three compensation stages arranged in sequence, and each of the compensation stages corresponds to one of the red sub-pixel, the green sub-pixel and the blue sub-pixel.

16. The pixel compensation apparatus according to claim 15, wherein the sub-pixels to be compensated in the three compensation stages are in the order of the red sub-pixel, the green sub-pixel and the blue sub-pixel.

17. The pixel compensation apparatus according to claim 10, wherein the electroluminescent display panel comprises a red sub-pixel, a green sub-pixel, a blue sub-pixel and a white sub-pixel, the compensation period comprises four compensation stages arranged in sequence, and each of the compensation stages corresponds to one of the red sub-pixel, the green sub-pixel, the blue sub-pixel and the white sub-pixel.

18. The pixel compensation apparatus according to claim 17, wherein the sub-pixels to be compensated in the four compensation stages are in the order of the red sub-pixel, the green sub-pixel, the blue sub-pixel and the white sub-pixel.

19. A display device comprising the pixel compensation apparatus according to claim 10.

* * * * *